United States Patent [19]

Mirabel et al.

[11] Patent Number: 4,910,953

[45] Date of Patent: Mar. 27, 1990

[54] DEVICE FOR COMMUNICATING A FALSE TWIST BY FRICTION TO AT LEAST ONE MOVING YARN

[75] Inventors: Pierre Mirabel; Marcel Schoumacher, both of Roanne, France

[73] Assignee: Devtex, France

[21] Appl. No.: 222,430

[22] Filed: Jul. 21, 1988

[30] Foreign Application Priority Data

Aug. 28, 1987 [FR] France ..... 87 12175

[51] Int. Cl.[4] ..... D01H 7/92

[52] U.S. Cl. ..... 57/336; 57/104; 57/348

[58] Field of Search ..... 57/334, 336, 348, 104, 57/105

[56] References Cited

U.S. PATENT DOCUMENTS

| | | | |
|---|---|---|---|
| 2,262,589 | 11/1941 | Peck . | |
| 2,908,133 | 10/1959 | Brown . | |
| 4,144,700 | 3/1979 | Takai et al. | 57/336 X |
| 4,248,038 | 2/1981 | Takai | 57/348 X |
| 4,296,598 | 10/1981 | Faure | 57/336 X |
| 4,566,265 | 1/1986 | Naylor | 57/336 |
| 4,698,959 | 10/1987 | Schippers et al. | 57/336 |

FOREIGN PATENT DOCUMENTS

| | | | |
|---|---|---|---|
| 2755809 | 7/1978 | Fed. Rep. of Germany | 57/336 |
| 1076599 | of 1954 | France . | |
| 1191361 | 10/1959 | France . | |
| 1255922 | of 1961 | France . | |
| 2484471 | 12/1981 | France . | |
| 2493882 | 5/1982 | France . | |
| 27851 | 3/1977 | Japan | 57/336 |
| 405861 | 2/1934 | United Kingdom | 57/104 |
| 1051587 | 11/1966 | United Kingdom . | |
| 2080345 | 2/1982 | United Kingdom | 57/336 |

*Primary Examiner*—Joseph J. Hail, III

*Attorney, Agent, or Firm*—Arnold, White & Durkee

[57] ABSTRACT

The device according to the invention enables a false twist to be communicated to a fibrous material. The device includes two endless belts or aprons inclined with respect to each other and mounted on two pairs of rollers. According to the invention, the support rollers supporting the two aprons are mounted on the casing proper of the spindle via two support arms, one of the support arms of each pair being subjected to the action of pressure for ensuring tension of each apron and at least one of the other two support arms being mounted in articulated manner on the casing. Parallelism between the axes of the rollers is not able to be respected.

6 Claims, 2 Drawing Sheets

DEVICE FOR COMMUNICATING A FALSE TWIST BY FRICTION TO AT LEAST ONE MOVING YARN

FIELD OF THE INVENTION

The present invention relates to an improved device for communicating a false twist by friction to at least one moving yarn.

BACKGROUND OF THE INVENTION

The technique consisting in communicating a false twist to a yarn by friction has been known for a long time. This technique generally consists in placing the moving yarn in contact with a mobile surface, moving transversely with respect to the path of said yarn, so that the latter is twisted upstream and resumes its initial twist downstream.

This technique, for which numerous applications have been envisaged, has been especially used up to the present time for texturing synthetic yarns, i.e. for communicating thereto voluminosity and elasticity by a heat treatment followed by a cooling of the yarn upstream of the false twist member.

Various other applications of false twist have also been envisaged, particularly for making fancy yarns, yarns presenting alternate twists over their length, self-twisted yarns, simple or complex spun yarns of fibers, for example comprising an internal core.

Numerous solutions have been proposed for the mobile surface for communicating a twist to a yarn by friction. Those used up to the present time in the domain of texturing employ either bushings against the surface of which the yarn is in contact (false twist by internal friction) or overlapping discs mounted on parallel spindles, the moving yarn coming into contact with the outer surface of said discs (false twist by external friction).

It has long since been proposed, particularly in French Pat. Nos. 1,191,361, and 1,255,922, and in U.S. Pat. No. 2,908,133, to constitute the member for communicating the false twist by one or more endless belts or aprons against the surface of which the yarn rubs.

It has also been proposed, as disclosed in U.S. Pat. No. 2,262,589 and French Pat. No. 1,076,599, to communicate a false twist by passing the yarn, whether it is based on continuous filaments or on discontinuous fibers, between two mobile aprons, these aprons being disposed obliquely with respect to each other so that the yarn is given a certain impulsion in the direction of its displacement during passage thereof between the aprons. The invention relates to an improvement to this latter type of false twist device.

Such a device incorporating aprons will be referred to in the following specification as an "angled apron spindle".

Among the problems raised for such angled apron spindles and which are a function of the material treated, the speed of production, the rate of twist which it is desired to communicate, mention may be made of those of the inclination of one apron with respect to the other, of the pressure of said aprons against each other, and/or of the tension of each of the aprons.

Furthermore, such spindles must be able to allow easy positioning of the yarn at start-up, must offer the possibility of regulating the speed of advance of the aprons and must enable said aprons to be easily changed when they are worn out.

Taken separately, each of these problems can be solved without difficulty by the man skilled in the art.

On the other hand, no solution has yet been proposed for solving them simultaneously.

Moreover, in all the devices proposed up to the present time, there is the problem of maintaining the aprons in position around their support rollers, being given that, in normal operation, said aprons under the action of the stresses exerted by the passage of the yarn tend to move transversely, which disturbs correct operation. At the present time, in the textile domain, in order to hold the aprons around the drive rollers, for example in the spindles or even in the yarn delivering members, the solutions proposed have consisted either in providing rollers whose width is less than the width of the aprons, or in using convex rollers.

Finally, at the present time, in such angled aprons, it is necessary to have rollers presenting a relatively large diameter, which rollers are always of equal diameters, which results in increasing the space requirement of such spindles and especially in removing the twisting member from the means which deliver the material (yarn or fiber) to be treated.

An improvement to such types of angled apron spindles has now been found, and this forms the subject matter of the present invention, improvement which is particularly simple, easy to use and maintain, of small dimensions, which not only enables the above-mentioned adjustments (inclination of the aprons, pressure therebetween, . . . ) to be easily obtained, but also eliminates any risk of slide of the aprons with respect to the support rollers.

SUMMARY OF THE INVENTION

The invention therefore generally relates to an improvement in angled apron spindles for communicating a false twist by friction to a fibrous material (continuous yarns, roves of discontinuous yarns, . . . ). The spindles comprise two endless belts or aprons, inclined with respect to each other, mounted on two pairs of rollers, having two sides in mutual contact. The fibrous material passes between these aprons in the zone where they are in contact, with the result that, on the one hand, they communicate a false twist thereto and, on the other hand, they tend to deliver the yarn formed. The said spindles comprise in combination:

means for modifying the inclination of the two aprons with respect to each other;

means for adjusting the pressure (or spaced apart relationship) of the aprons against each other; and means for rotating the apron support rollers as well as for connecting and disconnecting them. The support rollers supporting the two aprons are mounted on the casing proper of the spindle via two pairs of support arms (one for each roller). One of the support arms of each pair is subjected to the action of pressure means ensuring tension of each apron. At least one of the two other support arms is mounted in an articulated manner on the casing and the parallelism between the axes of the rollers is not able to be respected.

Preferably, according to the invention, the two support rollers of each apron have different diameters. The diameter of the roller located foremost with respect to the spindle casing being clearly smaller. The surfaces of said rollers and the aprons that they support comprise, one, at least one continuous groove, the other, at least one complementary part in relief, thus ensuring strict positioning of the aprons in space despite the lack of parallelism of the axis which such a simplified design may cause. Such positioning will be maintained whatever the angle of the straps and therefore the effort exerted thereon and which tends to drive them from the rollers.

The driving rollers of each pair are driven by means of an endless belt common to the two rollers.

The device according to the invention is associated in a known manner, on the one hand, with means for delivering at least one fibrous material between the two aprons as well as with means for intake and winding of the yarn thus treated.

Furthermore, it may be associated with any known means making it possible:

either to treat the yarn thermally upstream and/or downstream of the device, for example when it is desired to make a textured yarn, a shrunk yarn, . . . ;

to vary the flow rate of the yarn and/or the length over which the twist extends back upstream of said device when it is desired to obtain a yarn presenting an alternate tension;

or to deliver one or more roves of fibers rendered parallel to which it is desired to communicate cohesion.

In other words, such a device may be used both for treating yarns with continuous filaments and spun yarns of fibers, and even roves alone or in association with other textile elements.

BRIEF DESCRIPTION OF THE DRAWINGS

The invention will be more readily understood on reading the following description with reference to the accompanying drawings, in which.

In the following description, the invention will be described for a spindle in which the textile material (designated by the expression "yarn" but which may be constituted by fibers), advances horizontally, but it is obvious that this is not limiting and that such a material may advance vertically or form any other angle. Taking this arrangement into account, the terms "lower" and "upper" will be used for differentiating the different elements of such a spindle.

DETAILED DESCRIPTION OF THE DRAWINGS

Figure 1:
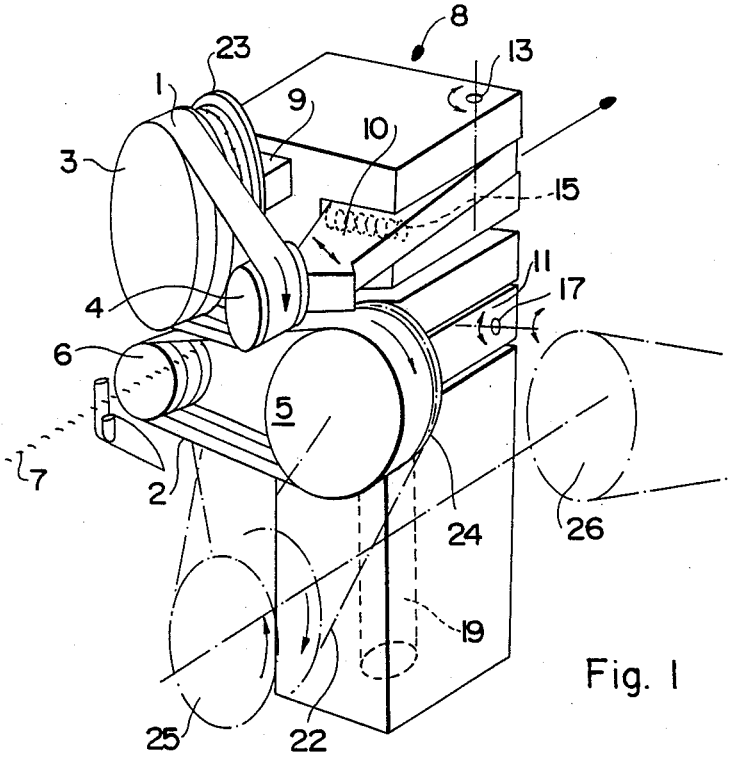
FIG. 1 is a schematic view in perspective showing the whole of an angled apron spindle according to the invention.

Referring now to the drawings, and firstly to FIG. 1, the angled apron spindle according to the invention is of the type comprising two endless belts or aprons 1, 2, mounted on two pairs of rollers 3, 4, 5, 6, disposed face to face and inclined one with respect to the other so that, in normal operation, when the fibrous material 7 (roves, continuous filaments, combination of such elements, ...) passes between these aprons in the zone where they are in contact and they communicate thereto a false twist and tend to deliver it.

According to the invention, the aprons 1, 2 are mounted on a casing 8 fixed to the casing of the machine in the following manner.

Firstly, each roller 3, 4, 5, 6 is mounted individually at the end of a support arm 9, 10, 11, 12, respectively, the support arm 12 of the roller 6 not being visible in FIG. 1. These arms are designed in one piece and are mounted on the casing so as to be able to be changed if necessary. As shown in FIGS. 2 to 5, the ends of the arms on which are mounted the support rollers are inclined in order to obtain the desired angle between the two aprons. It therefore suffices, in order to modify this inclination, to provide support arms comprising ends inclined differently.

For each apron 1, 2, one of the arms, in the present case arm 12 for the lower apron and arm 10 for the upper apron, is subjected to the action of means for modifying the tension of each of the aprons. This is obtained in the embodiment illustrated, by mounting each arm 10, 12 to pivot about a pivot pin 14, 13 the body of the arm itself being subjected directly to the action of springs 15, 16 (only spring 15 being illustrated in FIG. 1). In this way, a simple articulation is effected. It is true that, in such a design, the parallelism between the axes of the rollers supporting the aprons may not be respected, but it is possible to obtain a perfect positioning and hold of the aprons on said rollers thanks to the preferred embodiment according to the invention which will be seen in the following description and in which the surface of said rollers and that of the aprons comprises parts in relief and corresponding complementary grooves.

Furthermore, in order to be able to adjust the pressure of the two aprons one against the other, the lower arm 11 is itself mounted on the casing 8 so as to be able to pivot angularly about a pivot pin 17. Such pivoting may be controlled by a pneumatic jack 19 and therefore not only ensures tension of the lower apron 2 against the upper apron 1 in normal operation, but also effects an automatic separation of the two aprons, for example when the machine stops, thus avoiding any adhesion therebetween. The tension between the aprons 1 and 2 may be adjusted by means of a fixed and adjustable stop (not shown in the accompanying drawings) and which is interposed between the surface of the arm 11 and the surface of the body 8 inside which this arm is mounted.

Such an embodiment therefore makes it possible to effect disconnection of the aprons 1, 2 upon opening and connection after start-up, which avoids a prolonged contact between the aprons of which the temperature is generally relatively high after long operation, which may provoke adhesion thereof and consequently high moments upon start-up and deterioration of the surface state of the aprons. This therefore also allows an adjustment of the intersection of the aprons 1, 2 by simple displacement of one of the apron supporting rollers.

According to the embodiment illustrated, the upper arm 8, 9 which supports the roller 3 is fixed.

Figure 6:
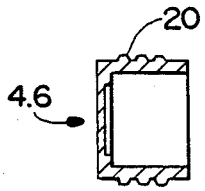
FIGS. 6 and 7 are sections showing the structure of the rollers supporting an apron.
Figure 7:
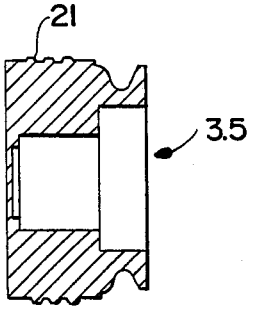
Figure 2:
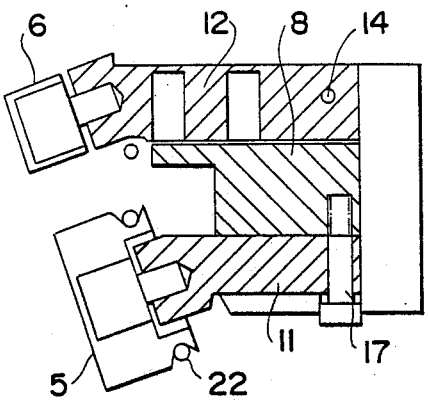
FIGS. 2 and 3, as well as FIGS. 4 and 5, schematically show, seen in plan view, in the case of a spindle in which the yarn advances horizontally as illustrated in FIG. 1, the manner in which the rollers supporting the lower apron (FIGS. 2 and 3), on the one hand, and the rollers supporting the upper apron (FIGS. 4 and 5), on the other hand, are mounted on the casing.
Figure 4:
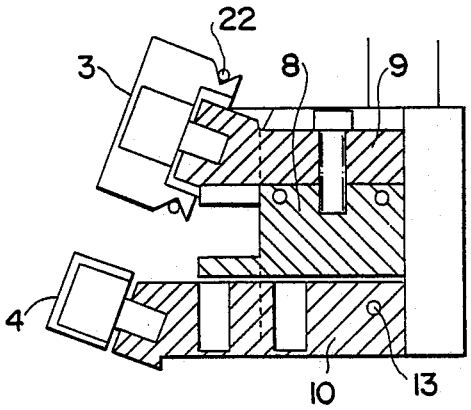
Figure 3:
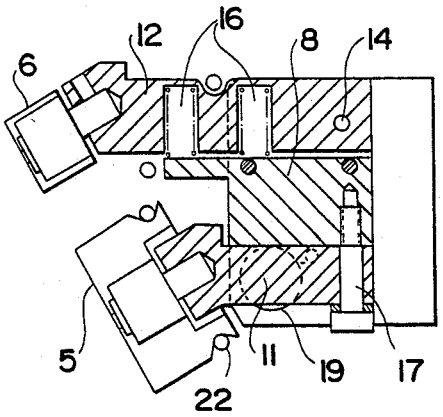
Figure 5:
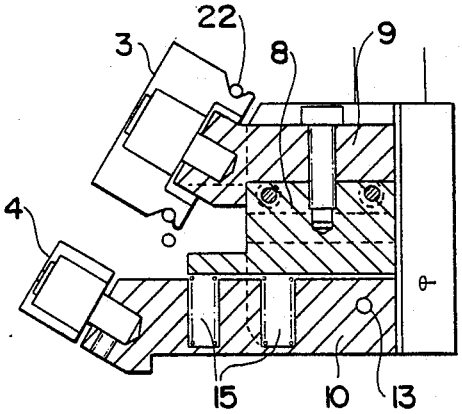

Furthermore, according to the invention, in order to ensure perfect hold of the aprons 1, 2 on the surface of the rollers, the latter comprise parts in relief 20, 21, three in number in the present case (see FIGS. 6 and 7), whilst the inner surface of each of the aprons comprises corresponding grooves. Such a grooving of the straps makes it possible strictly to fix their position in space despite the lack of parallelism between the axes which may result from the simplicity of such an articulation. This fixed position can be achieved whatever the angle between the straps and therefore the effort exerted thereon and which tends to displace rollers.

Finally, in the embodiment illustrated, it is possible to obtain a very compact spindle by making the rollers located foremost with respect to the casing 8 with a diameter clearly smaller than the driving rollers 3, 5 proper, these latter being driven by a single continuous drive belt 22 which surrounds each roller 3, 5 by passing inside a groove 23, 24. Control of this drive belt 22 is obtained by a pulley 25 driven by an appropriate motor 26. These control elements are simply schematized in chain-dotted lines in FIG. 1.

Owing to such a spindle design, it is possible to obtain a perfectly compact assembly, ensuring very regular operation from position to position, which is easy to maintain and adjust.

The invention is, of course, not limited to the embodiment described hereinabove, but covers all the variants thereof made in the same spirit. It is thus obvious that the scope of the invention will not be exceeded by making supporting rollers for each of the aprons with equal diameters.

What is claimed is:

1. A device for communicating a false twist by friction to a fibrous material, comprising:

a casing member;

a first pair of integral support arms mounted on the casing member in a manner to allow easy replacement thereof, said support arms having ends which are each inclined at substantially an equal first angle;

a first pair of support rollers arranged on said ends of said first pair of integral support arms;

a first endless belt or apron mounted on said first pair of support rollers;

a second pair of integral support arms mounted on the casing member in a manner to allow easy replacement thereof, said support arms having ends which are each inclined at substantially an equal second angle, which is inclined with respect to said first angle;

a second pair of support rollers arranged on said ends of said second pair of integral support arms;

a second endless belt or apron mounted on said second pair of support rollers, such that a portion of said second endless belt or apron contacts a portion of said first endless belt or apron;

means for adjusting the tension of each endless belt or apron, said means comprising a pivot pin supported by said casing and inserted through a pivot point of at least one of the support arms of each pair of support arms, said pivot point being located distal from said end of each support arm, and at least one spring member for urging the support arms of each pair of support arms apart;

means for adjusting the pressure at which the endless belts or aprons contact each other, said means comprising a pivot pin inserted through at least one dim of one of said pairs of support arms, and pressure means for urging said at least one arm in a direction to increase the belt contact pressure; and means for rotating, connecting, and disconnecting said support rollers;

wherein said fibrous material is transmitted between the two endless belts or aprons at said portion of contact therebetween, whereby the endless belts or aprons communicate a false twist to the fibrous material and deliver the fibrous material so formed.

2. The device of claim 1, wherein said pressure means comprises a pneumatic jack which urgers the two endless belts or aprons together during operation of the device, and automatically separates the two endless belts or aprons when the device is inoperative, to avoid adhesion between the two endless belts or aprons.

3. The device of claim 1, wherein said pressure means comprises a fixed and adjustable stop which is interposed between a surface of the pair of support arms which is pivoted and a surface of the casing member in which said pair of support arms is mounted.

4. The device of claim 1, wherein the support roller of each pair of support rollers which is spaced furthest from said casing member has a smaller diameter than the other support roller of each pair of support rollers.

5. The device of claim 1, wherein the surface of each roller which contacts the endless belt or apron comprises at least one continuous groove, and the surface of each belt or apron which contacts the support rollers comprises at least one depression which is complimentary to said at least one continuous groove, whereby strict positioning of the belts or aprons is ensured.

6. The device of claim 1, wherein driving rollers of each pair of support rollers are driven by means of an endless belt which is common to the driving rollers.

* * * * *